United States Patent [19]

Elo

[11] 3,975,263

[45] Aug. 17, 1976

[54] MATERIAL SEPARATION APPARATUS AND METHOD

[76] Inventor: Heikki K. Elo, P.O. Box 799 - Uhler Road, Easton, Pa. 18042

[22] Filed: Feb. 25, 1975

[21] Appl. No.: 552,943

[52] U.S. Cl. ..... 209/138; 209/154

[51] Int. Cl.[2] ..... B07B 7/01

[58] Field of Search ..... 209/136–139 R, 209/140, 141, 146, 147, 154

[56] References Cited

UNITED STATES PATENTS

| | | | |
|---|---|---|---|
| 1,877,861 | 9/1932 | Hatch | 209/139 R |
| 2,683,685 | 7/1954 | Matheson | 209/141 X |
| 3,062,458 | 11/1962 | Dearing | 209/138 X |
| 3,142,869 | 8/1964 | Gould et al. | 209/141 X |
| 3,265,209 | 8/1966 | Wochnowski et al. | 209/154 X |
| 3,738,483 | 6/1973 | Mackenzie | 209/137 |

FOREIGN PATENTS OR APPLICATIONS

| | | | |
|---|---|---|---|
| 728,290 | 7/1932 | France | 209/139 R |

*Primary Examiner*—Frank W. Lutter
*Assistant Examiner*—Ralph J. Hill
*Attorney, Agent, or Firm*—James F. Jones

[57] ABSTRACT

Apparatus for the aerodynamic separation of a heterogeneous mixture of materials of different weights into component parts thereof is provided which comprises a vertical separation column, means for feeding the waste material to be separated in an air suspended state into the separation column, additional air means for blowing air upwardly into the treating column from its lower end thereof to aid in the passage of waste material upwardly through the treating column, and a plurality of air jet means provided in spaced arrangement in the upper portion of the treating column for imparting jet streams of air into the column for creating and maintaining a plurality of zones of turbulence in the upper portion of the column thereby facilitating the separation of the waste material into its component parts. The present invention includes the method of separating the heterogeneous mixture of material utilizing the jets of air in a controlled manner.

10 Claims, 3 Drawing Figures

MATERIAL SEPARATION APPARATUS AND METHOD

FIELD OF THE INVENTION

The present invention relates to apparatus and a method for separating a heterogeneous mixture of said materials into various fractions having different weights. More specifically, the present invention relates to apparatus and a method for use with solid waste material to effect a separation of such a mixture by means of air or other pneumatic means into light and heavy fractions in a new and novel manner to permit the ready disposal or recycling and recovery of such fractions.

DESCRIPTION OF THE PRIOR ART

In many industries where the handling of a heterogeneous mixture of solid materials is involved, a need has always existed to effect a separation of the mixture into fractions or parts on the basis of the size, shape, density or weight of the particles making up the material. In effecting such separation on a size or shape basis, the usual procedure is to pass such a mixture through a screened processing zone wherein a screen having meshes of decreasing or increasing sizes is employed to effect the separation. However, in the situation where the separation is to be achieved on the basis of the specific gravity or the weight of the particles making up the material, an air or pneumatic classification is a technique that has been extensively employed heretofore. It is with this type of separation that the present invention is concerned.

In a pneumatic or air classification system, which is predicated on the formation of an air suspension of the mixture to be separated, such separation is based on the settling velocity of the particles involved. The settling velocity of a particle in a mixture is a function of its shape, size and density, and should there be a large range of difference in any of these three factors, separations can be achieved in an air stream only by the use of a number of air separation systems. Also, if some form of pre-separation is used, such as screening by particle size, then air classification of the screened fractions will be used to provide separations primarily on the basis of density or weight. However, most air classification systems that have been employed heretofore have not been found to be very efficient, particularly when the moisture content of the material to be separated is sufficiently high to cause lumping of the particles making up the waste material. Municipal and commercial solid waste tend to become subjected to moisture and as a result oftentimes become quite lumpy.

A great many patents have been issued in the field of air separation of mixtures into various fractions with such patents being developed for a number of diverse industries. Representative of such patents are U.S. Pat. No. 393,411 issued to Willis in 1888, U.S. Pat. No. Re. 14,266 issued to Bryan et al in 1917, U.S. Pat. No. 1,660,682 issued to Stebbins in 1928, U.S. Pat. No. 1,877,861 issued to Hatch in 1932, U.S. Pat. No. 2,162,392 issued to Solomon, Jr. et al in 1939, U.S. Pat. No. 2,351,351 issued to Maxwell et al in 1944, U.S. Pat. No. 2,579,228 issued to Erickson in 1951, U.S. Pat. No. 2,766,880 issued to Schaub et al in 1956, U.S. Pat. No. 3,036,706 issued to Taudiere in 1972, U.S. Pat. No. 3,090,487 issued to Doyle in 1962, U.S. Pat. No. 3,265,209 issued to Wochnowski et al in 1966, U.S. Pat. No. 3,312,343 issued to Elder et al in 1967, U.S. Pat. No. 3,397,780 issued to Beuzeval in 1968, U.S. Pat. No. 3,441,131 issued to Gebauer in 1969, U.S. Pat. No. 3,555,794 issued to Gable, Jr. et al in 1971, and U.S. Pat. No. 3,572,503 issued to Hazel in 1971.

As hereinbefore indicated and as shown by the aforementioned patents, a great many widely different industries have employed a pneumatic classification and separation procedure to effect a separation of a diverse mixture into fractional components on a weight or specific gravity basis. The present invention is primarily concerned with the field of waste material disposal and the processing thereof to place such material in a proper state for disposal or recovery for recycling. However, it is to be clearly understood that the system of the present invention can be employed or otherwise adapted for the separation of other mixtures of materials into fractions thereof based on a weight or specific gravity basis.

In the separation of waste materials, and particularly municipal waste materials, considerable work has been devoted over several years in an effort to answer the need for environmental protection, that is of so much concern at this time. One such development has involved the use of hammermills to effect a substantially uniform reduction of size of the waste material by chopping, shredding, grinding, or the like, after which the material may be subjected to a size or shape separation, if need be, followed by an air or magnetic separation of the material into various fractions.

One such system that has been employed is known as a front end system wherein the refuse is discharged from a size reduction treatment to an air classifier unit. In the air classifier unit the light fractions, which are primarily organic, and, therefore, combustible, and the heavy fractions, which are mostly made up of inert materials, are separated. Such an air classification system is a fairly simple, yet efficient, procedure when used to separate relatively homogeneous materials, even if the densities and aerodynamic characteristics of such materials are rather similar. For example, a mixture of aluminum wire and insulation material can be separated after an initial size reduction step and a friction treatment to physically remove the insulation from the wire. Refuse, however, even after shredding, is extremely heterogeneous and the mixture itself varies from batch to batch. As a result, attempts to achieve a high degree of separation among the various components in the waste stream through air classification have not yet proven successful.

Another system of waste material separation that has received some consideration is the so-called Zig Zag Air Classification System. In this type of system, waste material, such as, for example, a mixture consisting of mixed waste paper, aged compost, and non-ferrous trash from auto bodies, has been subjected to a size reduction and then fed to an air classifier unit. In this unit air is fed upwardly through the unit and is employed to force the lighter materials upward through the zig zag chute, while the heavier component fell to the bottom hopper of the unit. The lighter pieces either fall back into a second hopper or are carried on to another unit processor.

Another system that has been employed in the separation of municipal waste material has been the so-called horizontal air classification system. In such a system, the light materials tend to be carried further and the heavier materials drop out sooner than desired.

While these foregoing proposed systems of waste material disposal have met with some success, the widely diverse nature of the waste material to be treated has not permitted the attainment of the high degree of separation sought. Moreover, difficulty has been particularly encountered in prior separation systems where the materials to be separated have been damp, sticky, or the particles thereof have otherwise adhered to one another causing the formation of lumps. As a result, no system is available today which will permit a high degree of separation with any type of waste material under all conditions.

SUMMARY OF THE INVENTION

The present invention provides an apparatus and a method for the separation of a mixture of waste material by means of an air system into fractions having different weights or specific gravity. More specifically, the present invention is directed to the air separation of dry solid municipal waste material wherein a vertical separation column is provided into which a mixture of waste material and air is fed into the column near the bottom thereof for passage upwardly therethrough. The air employed with the waste material must be of a velocity and quantity sufficient to fluidize the waste material so that it will be conveyed upwardly through the separation column. The height of the vertical column must be such that a full and complete suspension of the waste material can be attained within the vertical confines of the column, thereby permitting the proper separation of the material into the desired fractions.

A secondary air inlet is provided for the vertical treating column adjacent the bottom end thereof and at a point below the entrance end for the air and feed material. The secondary air inlet means function to provide additional air to insure the desired velocity and amount of upwardly rising air within the column to form a proper suspension of the waste material within the column. The secondary air will also further insure that a proper passage of the waste material through the vertical column in a fully suspended state will be attained so as to facilitate the separation of the material into the desired fractions. The bottom end of the vertical treating column is provided with a discharge end which will receive the heavier particles which have fallen due to their weight and are not carried upwardly in the air stream through the vertical column.

Another aspect of the present invention is the provision of air jet means at selected vertically spaced points along the vertical length of the treating column, beginning above the air and material feed inlet opening. The function of the air jet means is to force jets of air into the treating column at controlled points therealong to create a state of turbulence in the upwardly moving stream of air and feed material. By the creation of such turbulence throughout the vertical column any clusters of material that may have been formed will be broken and the turbulence will spread the individual particles evenly across the cross-section of the column. This action will result in each particle being individually subjected to the effects of the upwardly moving air stream and thereby will result in a very high and fine degree of separation. The stream of air and waste material will thereafter pass upwardly and out through the upper exit end of the vertical column and then be carried to a separation unit where the light particles will be separated from the air stream in any desired manner.

Broadly stated, the present invention is a waste material separation unit comprising a vertical treating column, waste feed and air inlet means connected to said treating column adjacent the lower end thereof for feeding waste material and air thereinto in a suspended state, secondary air inlet means connected to the said vertical treating column at a point below the inlet end of said air and waste material, inlet means for feeding secondary air upwardly into said vertical column, a plurality of spaced air jet inlet means provided in said treating column at vertically spaced points therealong to feed air jets into said moving stream of air and waste material to maintain the air and waste material in a state of turbulence as it passes upwardly therethrough, first discharge means at the bottom thereof for removal of heavy fractions of waste material, and second discharge means at the top of said vertical column through which air and light fractions of waste material will be carried off.

DESCRIPTION OF THE PREFERRED EMBODIMENT

Figure 1:
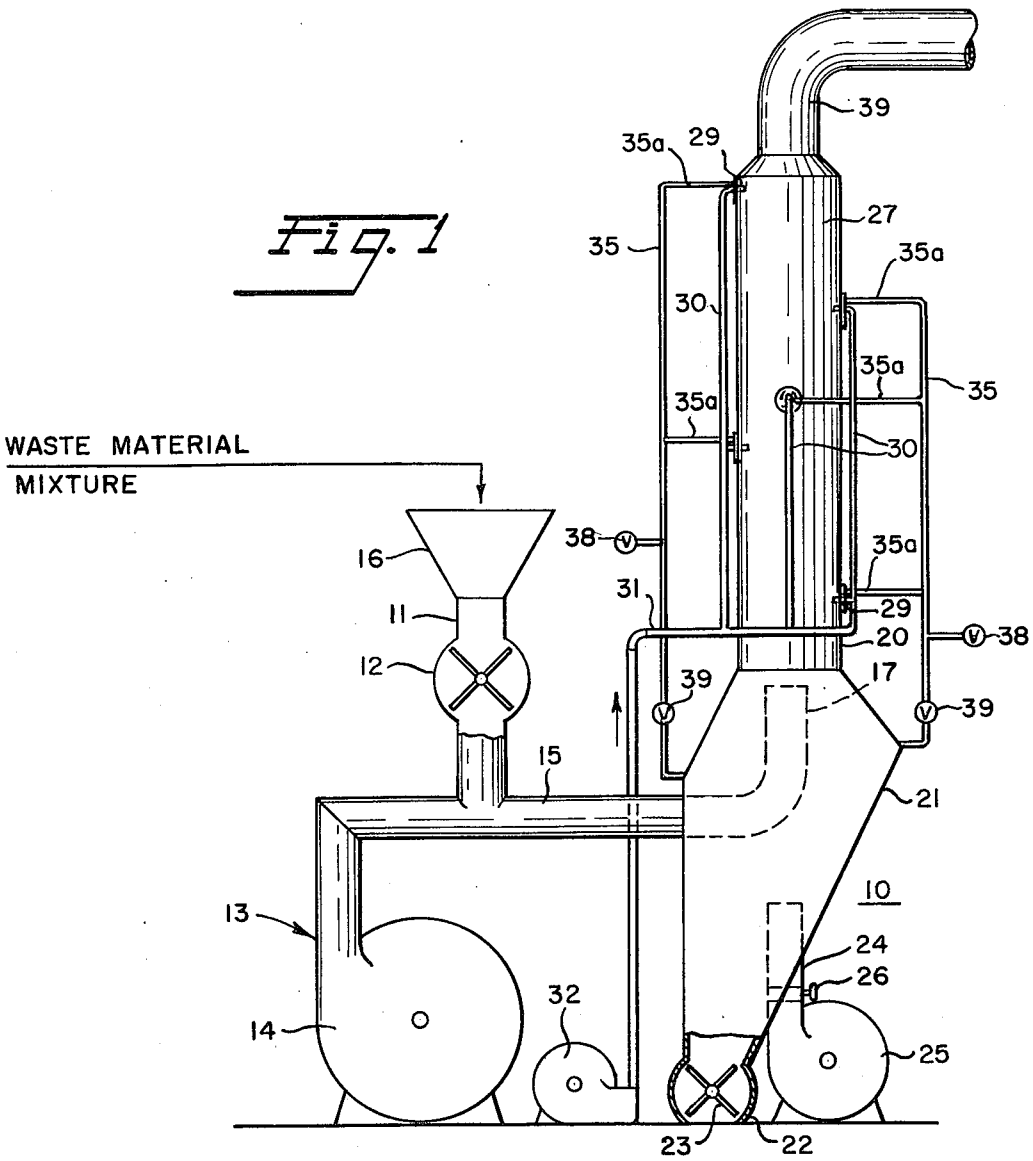
FIG. 1 is a side elevation of a waste material separation unit made in accordance with the present invention illustrating the movement of the waste material through the separation unit.

Referring now to the drawings and with particular reference to FIG. 1, the illustrative embodiment of the waste material separating unit made in accordance with the present invention and generally designated by reference numeral 10 is shown. The separating unit 10 has a waste material source feed line 11 which functions to carry the waste material from an initial size reduction processing unit (not shown) to the separating unit 10. Such a size reduction unit may be any suitable processing mechanism that will function to reduce the size of the waste material to small and generally uniform particles. Examples of such processing mechanism may be characterized as a hammermill unit which refers to any type of equipment that uses a pivoted or fixed hammer or cutter and thus includes high speed crushers, chippers, shredders, or grinders. Other types of size reduction equipment can be employed equally as well so long as it will place the waste material into a state consisting of a mixture of small particles.

The waste material to be separated by the separating unit 10 may be any waste mass made up of a mixture of materials that individually will possess different aerodynamic properties when placed in an air stream. Thus, the mixture of waste material must be made up of component parts having different weights or specific gravity such that it is possible to separate the aerodynamically heaviest materials from two or more aerodynamically lighter materials, or alternatively, to separate the aerodynamically lightest materials from two or more heavier materials.

The processed waste material to be separated is discharged through a suitable discharge mechanism, such as, for example, an air valve unit 12 into an air unit, generally designated by reference numeral 13. The air unit 13 includes an air feed line 15 and a blower 14 of a conventional design and having a capacity sufficient to provide enough air and at an adequate velocity so as to place the waste material mixture to be separated into an airborne and suspended state and will carry such suspended material into the separating unit 10. The air feed line 15 is connected at one end to the discharge end of the blower 14 and is also provided intermediate thereof with hopper means 16 into which the waste material mixture to be separated will be fed by gravity or by other conventional mechanical means. The waste material mixture so fed into the air feed line 15 from the hopper means 16 and its associated parts, to wit, feed line 11 and discharge valve 12, will then be mixed with the air passing through the air feed line 15 and the mixture will thus be placed in a state of suspension within the air stream so as to permit its transportation into the separation unit.

The air feed line 15 extends in a substantially horizontal plane forwardly from its point of attachment to the air valve means 12 of the hopper feed means 16 so as to advance the air-suspended waste material mixture forwardly in a horizontal plane. The air feed line 15 has its terminal end turned upwardly at substantially right angles to the horizontal forming an air and waste material discharge end 17 which is positioned centrally, as shown in broken lines, within the lower end of a vertically disposed separating column, generally designated by reference numeral 20.

The vertical separating column 20 may be made of any desired metal and may be mounted or attached to any suitable support or the like, as may be desired. The separating column 20 includes a lower portion 21 having an enlarged configuration or area with respect to the upper portion of the column 20, so as to provide an initial expansion area within the column. The air feed line 15 extends into the column 20 in the lower portion 21 thereof and the air discharge end 17 of the feed line 15 within the lower portion 21 extends upwardly. The bottom of the lower portion 21 of the column 20 is provided with a bottom discharge opening 22 within which rotary air valve means 23 of a conventional design and construction are positioned. The heaviest particles of the air and waste material mixture under processing in the column 20 will fall by gravity into the discharge opening 22 of the bottom portion 21 and may then be removed from the column 20 by the opening of the valve means 23. The heavy fraction thus discharged may be collected in hopper means (not shown), and passed to a moving conveyor means (not shown), or otherwise carried off for disposal or recycling in any manner desired.

A secondary air feed line 24 is connected at one end to an air blower 25 and the other end thereof extends upwardly into and centrally within the lower portion 21 of the column 20. The discharge end of the feed line 24 terminates below the vertical discharge end 17 of the air and waste material feed line 15. The function of the secondary air feed line 24 is to impart any needed additional air or to increase the velocity of the air and waste material mixture so that the suspended waste material will be easily carried upwardly within the separating column 20.

The amount or velocity of the secondary air needed in the column 20 will be found to vary with different mixtures of waste material having different weights or aerodynamic properties. To provide the desired adjustability for the secondary air, valve means 26 are mounted in the secondary air feed line 24 at an appropriate point. The valve means 26 makes it possible for the combined air and waste material mixture from feed line 15 and the secondary air from feed line 24 to have the desired velocity of rising air in the separating column 20. Thus, since each of the particles in the waste mixture has a specific air velocity that overcomes the pull of gravity, the separation of the aerodynamically different weight materials can be facilitated by adjusting the quantity of the secondary air by the control valve 26.

The vertical separating column 20 is provided with an upper portion 27 which has a smaller area in cross-section than the lower portion 21. It is preferred that the upper portion 27 of the tower 20 be tubular in configuration so as to insure a uniform passage of the air fluidized waste material mixture therethrough. The height or vertical length of the upper portion 27 must be sufficient to insure an adequate distance to permit the separation of the particles of the waste material mixture from one another. Similarly, the upper portion 27 must be of a diameter than will not only permit the desired particle separation but will also maintain the necessary velocity of the air to insure the desired pneumatic fluidization of the waste material mixture during the upward movement in the treating column or vertical tower 20.

The upper portion 27 of the vertical tower 20 is provided with a plurality of vertically spaced openings 28 along its vertical length thereof into which each opening an air jet nozzle 29 is positioned. Each of the jet nozzles 29 is connected to an air line 30 of a conventional structure, with each line 30 being connected to a common header air line 31. The common header air line 31 is connected to an air blower 32 which should be of a size and capacity sufficient to provide the necessary air for passage through each of the jet nozzles 29 at high pressure. This operation makes it possible to impart high pressure jet streams of air into the vertical treating column 20 at vertically spaced points therealong to produce a state of turbulence within the pneumatically fluidized waste material mixture moving upwardly through the column 20. The advantages of this operation will be described in greater detail hereinafter.

Any suitable type of air jet nozzles 29 may be employed herein that will impart the desired jets of high pressure air as well as additional air movement in the form of induced or entrained air, or both, into the pneumatically fluidized waste material mixture within the tower 20 by means and in a manner to be more fully described hereinafter. It is preferred that the jet nozzles 29 be of an eduction type wherein a small quantity of air under high pressure within the range of 30–100 p.s.i.g. is forced through the jets into the column 20. Such jet nozzles 29 are readily available commercially and are manufactured in various sizes with each size providing a specific quantity of air. Thus, the proper size nozzle to supply the necessary air for any given mixture of material can be readily selected. This jet action caused by the operation of the jet nozzles 29 will create a venturi effect wherein the exhaust operation of the jet nozzles will induce additional air to move in the direction of the initial jet blast and into the upper portion 27 of the vertical tower 20 and in the direction of the arrows 36 thereby creating a state of turbulence within the upwardly moving pneumatically fluidized waste material mixture to separate any lumped waste material into individual particles. This additional air may be obtained from sources and in a manner to be described more fully hereinafter.

Figure 2:
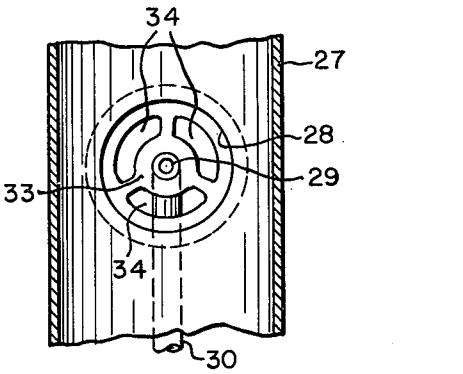
FIG. 2 is an enlarged fragmentary cross-sectional side view showing an illustrative embodiment of one form of the mounting of the air jets in the treating column to achieve the desired turbulence within the upwardly moving pneumatically fluidized mixture of materials with air inducing means and with air entraining means associated therewith.
Figure 3:
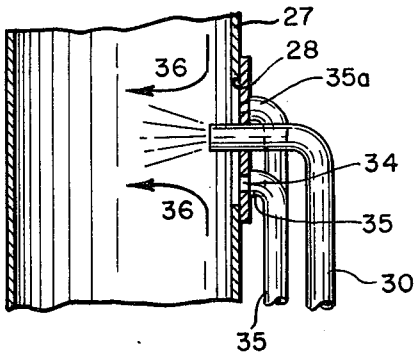
FIG. 3 is an enlarged fragmentary cross-sectional front view of the embodiment shown in FIG. 2 with the air inducing means removed from the mounting plate.

Reference is now to be had to FIGS. 2 and 3 wherein an illustrative embodiment of one form of a jet nozzle construction and its particular mounting in the vertical tower 20 that may be employed in the present invention is shown. It is to be clearly understood, however, that this particular form is illustrative in character only and that any jet nozzle construction that will impart the necessary high pressure jets of air into the column 20 and that will create the desired venturi effect so that the indicated turbulence within the column 20 will be achieved may be employed. In the following description, reference will be made only to one jet nozzle mounting, but it is to be clearly understood that such description will apply equally as well to each of the jet nozzles employed.

As illustrated in FIGS. 2 and 3, the opening 28 in the upper portion 27 of the column 20 is larger in diameter than the diameter of the barrel of the jet nozzle 29 so as to provide means by which air may be drawn into the interior of the upper portion 27 of the column 20 to further aid in forming the desired turbulence within the upper portion 27 of the tower 20. The opening 28 is covered by a mounting plate 33 which may be secured to the outside surface of the upper portion 27 of the column 20 by any suitable means, such as, for example, welding, riveting, bolting, or the like. The mounting plate 33 is provided with a central aperture into which the jet nozzle 29 will be centrally mounted in any suitable manner with such mounting being capable, preferably, of permitting easy withdrawal of the jet nozzle in the event a different size nozzle is to be used. The mounting plate 33 is provided with a plurality of openings 34 which extend around the periphery of the jet nozzle 29 and such openings provide direct access into the upper portion 27 of the interior of the column. Multiple openings are shown and the openings are illustrated as being arcuate in configuration in the drawings, but it is to be noted that they may be of any desired number and shape.

The direct access into the interior of the upper portion 27 of the column 20 provided by the openings 34 of the mounting plate 33 functions to permit the entry of additional air at vertically spaced points along the column 20 into the interior of the upper portion 27 of the column 20 in close association with the jets of high pressure air. This additional air may be atmospheric air drawn directly into the column 20 from the atmosphere through the openings 34 in the mounting plate 33 by the venturi action of the jets, as shown in FIG. 3. Alternatively, the air may be drawn into the upper portion 27 of the column 20 from the lower portion 21 of the column 20. This may be accomplished by the structure shown in FIGS. 1 and 2.

Illustrative means are shown in FIGS. 1 and 2 for passing induced air into the interior of the upper portion 27 of the column 20 from the lower portion 21 of the column 20 to aid in the formation of the desired turbulence. As shown in FIGS. 1 and 2, the illustrative means for imparting the induced air into the upper portion 27 of the column 20 through openings 34 of the mounting plates 33 include air feed line 35 connected at one end to the upper part of the lower portion 21 of the column 20 at points spaced below the inlet end of the feed line 15 into the column 20. The opposite end of the air feed lines 35 are each provided with arms 35*a*, each of which is operatively connected at its discharge end to an opening 34 of the mounting plate 33. It is to be understood that the configuration of the discharge end of each of the arms 35*a* of the air feed lines 35 will correspond to the configuration of the openings 34 so that they will be in tight and substantially sealed relationship.

Each of lines 35 adjacent the lower end thereof is provided with a valve unit 38 which will permit atmospheric air to be admitted into lines 35, if desired. A valve unit 39 is also positioned in each of the lines 35 at a point below the entry of the valve unit 38 into lines 35. The function of the valve unit 39 is to close off the passage of air from the lower portion 21 of the column 20 in those circumstances where it is deemed advisable.

In operation with this embodiment shown in FIGS. 1 and 2, the high pressure air will pass into the upper portion 27 of the column 20 through jet nozzle 29 and by means of the venturi effect created thereby induced air will also be drawn into the interior of the upper portion 27 of the column 20 from the lower portion 21 of the column 20 through air feed lines 35 and hence through the openings 34 of the mounting plate 33. The high pressure air flow through nozzle 29 and induced air through openings 34 will further entrain additional air flow within the column 20 in the direction of arrows 36. Essentially the same operation will occur when the valve units 39 in air feed lines 35 are closed and atmospheric air is drawn into the column 20 through the opening of valve units 38 by the venturi action created by the operation of the jets 29. It is to be noted, as shown in FIG. 1, a combination of induced air from lower section 21 or from the atmosphere may be employed by manipulation of air valve units 38 and 39. If desired and to control the amount of air that will be drawn into the upper portion 27 of the column 20, the valve units 38 and 39 can be controlled to any degree.

From the foregoing it is seen that the jet action of the nozzles 29 will create a venturi effect which will induce additional air to be drawn into the upper portion 27 of the column 20 through air feed lines 35 from the lower portion 21 of the column 20. By opening valve units 38 a portion of the induced air to be used can be drawn from the atmosphere, while on opening of the valve units 38 and closing of the valve units 39 all of the needed induced air can be drawn from the atmosphere. Also, by closing both valve units 38 and valve units 39 no induced air will be introduced into the column 20. The jet action from the jet nozzles 29 together with the induced air through openings 34 or alternatively the jet action from the jet nozzles 29 alone will entrain large amounts of air within the column 20 to move the direction of arrows 36, thus increasing the turbulence effect caused by the air jets. The total state of turbulence within the upwardly moving pneumatically fluidized waste material mixture acts to separate all particles lumped together into individual particles.

The use of the jet nozzles is to create, as hereinbefore indicated, a state of turbulence within the upwardly moving pneumatically fluidized stream of waste material mixture within the vertical column 20 thereby overcoming inherent problems that have been encountered heretofore in prior separation systems. It has been found that in passing a pneumatically fluidized mixture of materials having different specific gravities through a separating column, there is oftentimes a tendency for particles making up the mixture to agglomerate with one another forming clusters of material which well may fall out of the moving stream of waste material and be collected when such particles should not have been. Moreover, in the operation of such prior separation systems, an accumulation of material will oftentimes be found to occur in the side walls of the column and thereby reducing the efficiency of the entire system.

In accordance with the present invention, the use of the jet nozzles 29 within the upper portion 27 of the column 20 in the manner hereinbefore indicated will eliminate the foregoing objectionable and inherent characteristics of prior separation systems. By the use of the jet nozzles 29 in the manner indicated so as to impart high pressure jets of air as well as draw additional air into the interior of the column 20, a high degree of turbulence will be created along substantially the entire vertical length of the upwardly moving pneumatically fluidized mixture of waste material. The creation of such turbulence within the upwardly moving stream of waste material will break up any clusters of particles of the waste material that may tend to adhere to one another. This formed turbulence will further spread individual particles of the waste material reasonably evenly across the cross-section of the interior of the upper portion 27 of the column 20, and thus subject each particle individually to the effects of the rising air stream. This action will increase the efficiency of the separation of the waste material. Further, by creating the turbulence, the maintaining of a smooth and clear interior surface within the column will be insured so that there will be no likelihood of waste material collecting on the wall of the column 20. Therefore, in the present invention no falling waste material particles will tend to accumulate within the interior of the column 20, and the cross section of the column 20 would not change and a reduction of the efficiency of the entire separation unit would not be created.

The number of jet nozzles 29 to be employed in the present invention may be any number desired to create the required turbulence within the upwardly moving stream of the mixture of waste material. As illustrated, five jet nozzles 29 are employed in the particular illustrative embodiment shown, but it is to be clearly understood that any number can be used so long as the desired turbulence is formed. Moreover, the jet nozzles 29 are shown as positioned in a staggered relationship, which is the preferred arrangement. It should be emphasized that the placement of the jet nozzles 29 is important for the successful operation of the invention in the sense that with the more alternately placed jet nozzles a greater turbulence will be created than with a lesser number of jets. The location and the number of jet nozzles 29 that are to be used are, therefore, factors that must be selected individually for each separating operation. The column 20 therefore should be so constructed as to be capable of accommodating a variety of arrangements.

Upper discharge means 39 are secured in any suitable manner to the top of the column 20 and function to carry off that portion of the pneumatically fluidized waste material made up of the air stream and the lighter particles of the waste material mixture. The upper discharge means 39 has a smaller diameter than the upper portion 27 of the column, and thus the velocity of the fluidized stream will be increased and will facilitate the carrying off of the air and the lighter particles of waste material. The upper discharge means 39 may be connected to a separator (not shown) or like unit of conventional design where the lighter particles of the waste material may be removed or otherwise separated from the air stream.

In the operation of the present invention, the waste material mixture to be processed may be obtained from a size reduction or other processing plant which will render the waste material mixture to a more uniformed particle size. The waste material mixture is discharged through the discharge opening 12 of the waste material feed line 11 into the feed line 15. The waste material is mixed with the air supplied to feed line 15 by means of the blower 14 and the waste material mixture is then placed in a pneumatically fluidized state. The fluidized waste material mixture is discharged from feed line 15 through the discharge end 17 into the lower portion 21 of the column 20. Secondary air is blown into the lower portion 21 of the column 20 by the air feed line 24 positioned at a point below the exit end of the discharge line 17 of the feed line 15. The secondary air will pass upwardly and will combine with the fluidized stream of waste material thereby insuring the desired velocity of the pneumatically fluidized stream of waste material. With this action, the heavier particles of the waste material mixture will not be carried upwardly by the formed air stream and therefore will drop by gravity into the lower or bottom end 21 of the column 20 into the discharge opening 22 of the column 20. This collected waste material will constitute the heavier fraction of the waste material but may be drawn from the column 20 by means of the discharge valve 23.

The pneumatically fluidized stream of waste material in admixture with the secondary air will pass upwardly into the upper portion 27 of the column 20 and will be subjected at spaced points therealong to the jets of high pressure air as well as a variable quantity of induced air drawn thereinto and entrained air from within the column at vertically spaced points to create and maintain a state of turbulence within the upwardly moving stream of waste material. This action will insure a full separation of the particles making up the remainder of the waste material, which will enhance the efficiency of the separation system and will enable a high degree of separation of the particles. The air stream containing the remainder of the particles of waste material constituting the lighter fraction will be discharged through the discharge opening means 39 secured to the top of the column 20 and the stream will be carried off to suitable separating means where the lighter fraction will be removed therefrom.

The present separation system has been shown in connection with a separation of a mixture of waste material into heavier and lighter fractions. However, it is to be clearly understood that the present invention can be employed equally as well in separating the waste material mixture into more than two fractions. Moreover, as has hereinbefore been indicated, the present invention has been primarily developed for use in the separation of municipal waste material. However, it is to be understood that the invention can be employed equally as well in effecting the separation of other materials so long as the mixture to be treated will contain materials capable of being placed in a pneumatically fluidized state and with the particles making up the mixture having different specific gravities.

While there have been described herein what are at present considered preferred embodiments of the invention, it will be obvious to those skilled in the art that modifications and changes may be made therein without departing from the essence of the invention. It is therefore to be understood that the exemplary embodiments are illustrative and not restrictive of the invention, the scope of which is defined in the appended claims, and that all modifications that come within the meaning and range of equivalency of the claims are intended to be included therein.

I claim:

1. A separation unit for the aerodynamic separation of a mixture of materials into at least two fractions comprising a vertically disposed separation column having substantially the same diameter throughout its vertical length, first inlet means secured to said separation column adjacent the lower end thereof for feeding a pneumatically fluidized mixture of materials into said column for upward passage therethrough, second inlet means secured to said separation column at a point below said first inlet means for passing secondary air upwardly into said column for admixture with the pneumatically fluidized air mixture, a plurality of air jet means secured in vertically spaced relationship to the upper portion of said separation column for feeding jets of high pressure air into said column at vertically spaced points to establish a plurality of vertical zones of turbulence with said pneumatically fluidized mixture of materials during its upward movement through said column, bottom discharge means secured to the bottom of said separation column for receiving and discharging the heavier particles of the pneumatically fluidized mixture of materials which have dropped from said mixture of materials during its upward passage through said column and upper discharge means secured to the upper end of the column for receiving and carrying off the mixture of air and the lighter particles of said mixture of materials from said column.

2. A separation unit in accordance with claim 1, wherein said second inlet means include valve means for varying the amount of secondary air to be fed into the column.

3. A separation unit for the aerodynamic separation of a mixture of materials into at least two fractions comprising a vertically disposed separation column, first inlet means secured to said separation column adjacent the lower end thereof for feeding a pneumatically fluidized mixture of materials into said column for upward passage therethrough, second inlet means secured to said separation column at a point below said first inlet means for passing secondary air upwardly into said column for admixture with the pneumatically fluidized air mixture, a plurality of air jet means secured in vertically spaced relationship to the upper portion of said separation column for feeding jets of high pressure air into said column at vertically spaced points to establish a plurality of vertical zones of turbulence with said pneumatically fluidized mixture of materials during its upward movement through said column, additional air inlet means secured to the upper portion of said separation column immediately adjacent each of said air jet means for passage of additional air into said column by the venturi effect created by said air jet means, bottom discharge means secured to the bottom of said separation column for receiving and discharging the heavier particles of the pneumatically fluidized mixture of materials which have dropped from said mixture of materials during its upward passage through said column and upper discharge means secured to the upper end of the column for receiving and carrying off the mixture of air and the lighter particles of said mixture of materials from said column.

4. A separation unit in accordance with claim 3, wherein at least a plurality of additional air pipe means are provided, one end of each of said air pipe means being connected to said column at a point below said first inlet means and the other end of each of said air pipe means being connected to one of said additional air inlet means for passing induced air into said column in association with the jets of high pressure air.

5. A separation unit in accordance with claim 4, wherein said additional air pipe means include air valve means to permit the controlled entry of air thereinto.

6. A separation unit in accordance with claim 3, wherein said additional air inlet means passes atmospheric air into said column in association with the jets of high pressure air.

7. A separation unit in accordance with claim 3, wherein said additional air inlet means each includes a mounting member having a central opening therein for receiving one of said air jet means, said mounting member having openings spaced around said central opening through which said additional air will pass.

8. A separation unit in accordance with claim 7, wherein at least a plurality of additional air pipe means are provided, one end of each of said air pipe means being connected to said column at a point below said first inlet means and the other end of each of said air pipe means being connected to said openings spaced around said central opening.

9. A method of pneumatically separating a mixture of different materials having different specific gravities comprising forming a pneumatically fluidized mixture of said different materials having different specific gravities, passing said pneumatically fluidized mixture of materials into the lower end of a vertically disposed treating zone having substantially the same diameter throughout its vertical length for upward passage therethrough, passing a stream of secondary air into said treating zone at a point below the entrance end of said fluidized mixture in an amount sufficient for admixture with said pneumatically fluidized mixture of materials to maintain the upward velocity thereof, passing jets of high pressure air into the upper part of said treating zone at vertically spaced points thereralong to create a plurality of vertically spaced zones of turbulence within said pneumatically fluidized mixture of materials, collecting the heavier particles of said mixture of materials that have dropped from the mixture of materials during its upward travel in the treating zone in the bottom of said treating zone to constitute the heavier fraction thereof, discharging the collected heavier fraction from the treating zone and discharging the air and the lighter fraction of the mixture of materials from the upper end of said treating zone.

10. A method in accordance with claim 9, which includes the further step of passing additional air into said treating zone in close association with each jet of high pressure air.

* * * * *